United States Patent [19]

Sudrabin

[11] Patent Number: 4,743,414

[45] Date of Patent: May 10, 1988

[54] COMPOSITE WALL FORMING PROCESS

[75] Inventor: David A. Sudrabin, Delray Beach, Fla.

[73] Assignee: Fibrestone Inc., LaBelle, Fla.

[21] Appl. No.: 865,459

[22] Filed: May 21, 1986

[51] Int. Cl.[4] ..... B28B 1/16

[52] U.S. Cl. ..... 264/35; 52/309.17; 264/145; 264/172; 264/256; 264/DIG. 57; 425/91; 425/101; 425/308; 425/315

[58] Field of Search ..... 264/35, 39, 46.7, 214, 264/256, 70, 216, 166, 167, 171, 145, 213, 172, 333, DIG. 57; 425/96, 101, 308, 315, 91; 52/309.17; 156/62.2, 68.8

[56] References Cited

U.S. PATENT DOCUMENTS

| | | | |
|---|---|---|---|
| 3,260,635 | 7/1966 | Page et al. | 264/70 X |
| 3,351,510 | 11/1967 | Harris | 264/214 X |
| 3,974,024 | 8/1976 | Yano et al. | 264/70 X |
| 4,132,043 | 1/1979 | Juba | 264/256 X |
| 4,185,437 | 1/1980 | Robinson | 264/256 X |
| 4,450,128 | 5/1984 | Takeuchi | 264/70 |
| 4,562,030 | 12/1985 | Sakaguchi et al. | 264/70 X |
| 4,614,013 | 9/1986 | Stevenson | 264/46.7 X |

FOREIGN PATENT DOCUMENTS

| | | | |
|---|---|---|---|
| 58-22144 | 2/1983 | Japan | 264/46.7 |

*Primary Examiner*—Richard L. Chiesa
*Attorney, Agent, or Firm*—Alfred E. Wilson

[57] ABSTRACT

An assembly line method of construction is applied to the making of the thin fiber reinforced shell that forms the external surface of the Fibrestone wall. An elongated endless movable belt has the desired recurring pattern tó be applied as the external surface of the fiber reinforced shell. Spray guns movable transversely of the elongated belt are provided to spray concrete and chopped up reinforcing fibers on the belt to form a continuous Fibrestone panel strip as the belt moves past the spray guns. A plurality of elongated flex-ties mounted on suitable supports and each having one of their ends adapted to be secured to the upper surface of the fiber reinforced shell are dropped onto the spray formed shell while it is in the plastic or uncured state. To insure that the flex-ties are securely bonded additional concrete and chopped up fibers are sprayed on the flex-tie supports, and the area between the rows of flex-ties are rolled to provide a relatively smooth surface between the rows of flex-ties. Guide paths are formed adjacent the flex-ties by wheels to receive the edges of the studs. The continuous panel with the flex-ties in place are passed through a rapid curing station and the continuous panel is then separated from the pattern carrying belt and the continuous panel is cut transversely into panels of commercial lengths. The pattern carrying belt is then cleaned, its tension is adjusted if necessary, and the pattern is treated with mold release substance, and the assembly is checked and is ready for the next cycle of operation.

11 Claims, 2 Drawing Sheets

COMPOSITE WALL FORMING PROCESS

BACKGROUND OF THE INVENTION

In instances where there are spaced parallel wall members in the walls of a building structure, it has been customary to connect the spaced wall members together with the shortest possible connectors, such as by direct bars, screw fasteners or ties connected to the spaced members. Where the building structure is subjected to temperature variations difficulties have been encountered due to the stresses exerted on the connectors. This is because of the extreme forces exerted due to the variations of the temperatures exerted on the outer structure subjected to atmospheric temperature, and the temperatures exerted on the inner structure shielded from the atmospheric temperatures by the outer wall or structure. These recurring stresses fracture the connections between the outer and inner wall structures.

These problems have been overcome by the provision of spaced connectors so constructed and arranged that a small degree of freedom of movement is available between the transversely spaced members to reduce the connector breaking stresses.

FIELD OF THE INVENTION

The Fibrestone wall has a fiber reinforced outer shell which is capable of withstanding the ravages of atmospheric exposure. It also has a load supporting inner structure to support the loads exerted on the wall. The outer and inner structures are operably connected together by transversely extending tension members connected at their opposite ends to widely spaced points transversely on the outer and inner structures.

This invention is directed to the rapid formation on an assembly line of the outer fiber reinforced member, having transversely spaced flex-ties or tension members secured thereto, and which are adapted to be connected to the inner load supporting structures of the Fibrestone wall.

DESCRIPTION OF THE PRIOR ART

While many assembly line projects have been in operation for the making of a wide variety of products, it does not appear that any of the assembly line projects heretofore developed include the fabrication of wall structures having spaced outer and inner structures capable of withstanding the differential of temperatures as is the case of the Fibrestone wall having an external structure subjected to atmospheric temperatures and which is connected to another structure such as a load supporting structure shielded from the atmospheric temperatures and wherein the two structures must be connected together.

SUMMARY OF THE INVENTION

An assembly line is provided for the making of a composite wall having an outer surface to be subjected to atmospheric conditions. This fiber reinforced shell is preferably formed by simultaneously spraying concrete and reinforcing fibers into a mold carried by a traveling belt and having thereon the pattern or texture of a wall which it is desired to form.

The fiber reinforced shell is adapted to be secured to a load supporting structure secured to the inner surface of the fiber reinforced shell. This load supporting structure is shielded from the atmospheric temperatures by the outer fiber reinforced shell, and therefore is not subjected to the extremes of temperature to which the outer shell is subjected.

The outer shell and the inner load supporting structure are secured together by flex-tie connectors. One end of each of the flex-tie connectors is secured to the then upper surface of the outer shell while the concrete and reinforcing fibers of which it is formed is in an uncured or molten state. The other or upper end of the flex-tie connectors are later secured to the load supporting structure at points on the load supporting member that are spaced from the inner surface of the outer shell. This spacing permits limited movement between the outer and inner members to compensate in part for variations in the temperatures to which the outer and inner members are subjected.

The outer shell with the flex-tie connectors mounted thereon proceeds on down the assembly line, and after the pattern is withdrawn the continuous panel or shell is cut transversely by a traveling saw or other suitable cut-off device to provide panel members of the desired commerical sizes for use.

After the panel strip has been cut to provide panels of desired lengths for use, they can be placed in storage for additional curing, and can then be moved to the point of use.

If desired, after the panel members have been cut to the desired lengths for use, the load supporting structure consisting for example of a frame and spaced studs can be assembled with the individual members on the assembly line, and the flex-tie members can be secured to the studs at points spaced from the outer shell in any desired manner as by welding.

DESCRIPTION OF THE PREFERRED METHOD

Figure 1:
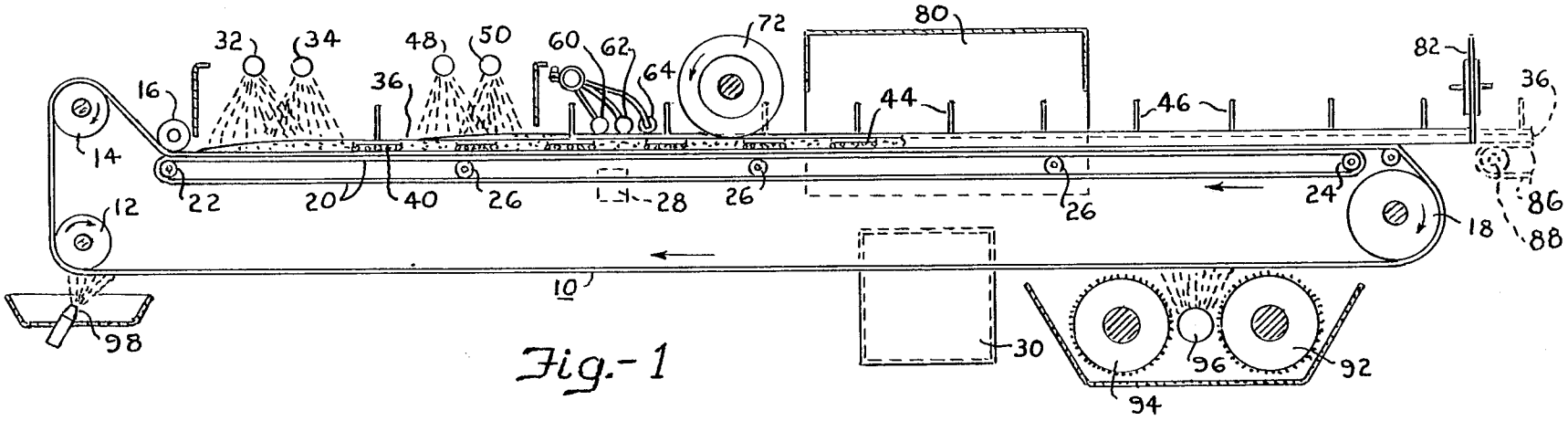
FIG. 1 is a side elevational view of an assembly line embodying this invention.
Figure 2:
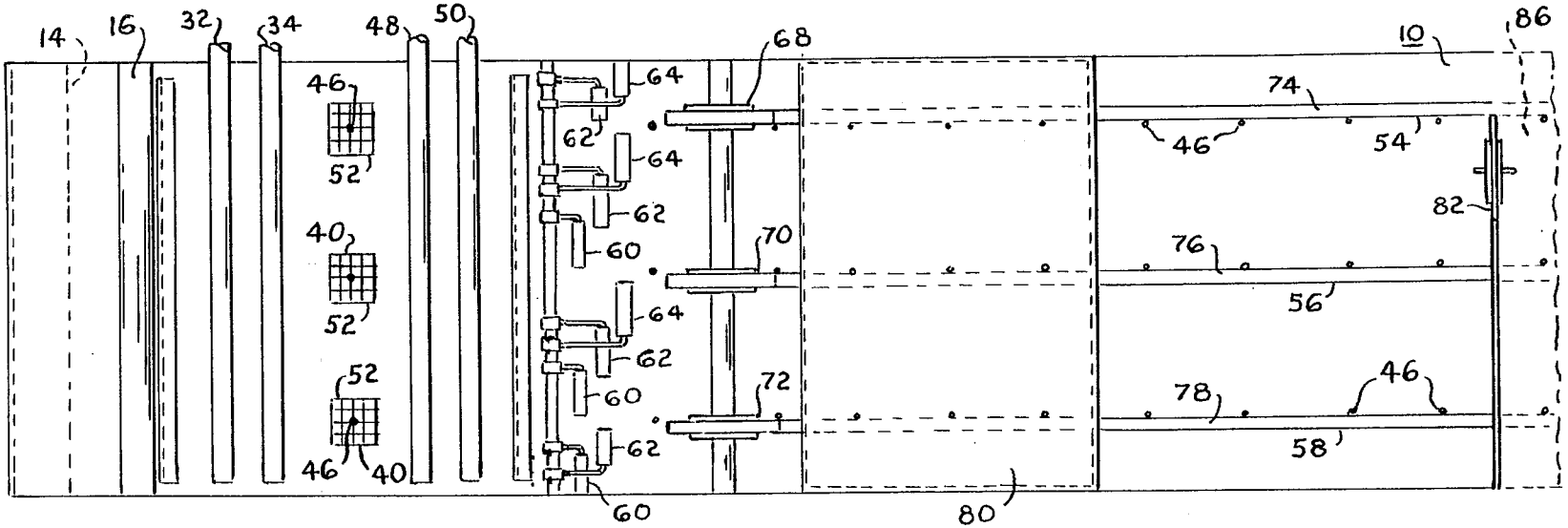
FIG. 2 is a plan view of the FIG. 1 assembly.

Referring now to FIGS. 1 and 2, a continuous endless belt 10 which carries the pattern or texture which it is desired to reproduce in the exterior surface of the wall to be reproduced is wrapped around spaced rollers 12 and 14 at one end, and is depressed by a roller 16 and extends to and is wrapped around a roller 18 spaced longitudinally from the rollers 12 and 14. The belt 10 rests in contact with and is supported and driven by a belt 20 which underlies and supports the pattern carrying belt 10. Spaced drive rollers 22 and 24 are provided to drive the drive belt 20, and with it the pattern carrying belt 10. A plurality of spaced support rollers 26, and belt tensioning devices 28 and 30 respectively are provided to maintain a suitable degree of tension in the belt drive 20 and in the pattern carrying belt 10 respectively.

The belt 10 is provided on it upper surface with the pattern or texture of the surface which it is desired to duplicate in the exterior surface of the outer shell of the Fibrestone wall which is to be exposed to the atmosphere. This pattern or texture can be a duplicate of or a reproduction of any surface which it is desired to embody in the outer shell of the wall. The desired pattern or texture of the surface to be reproduced is the outer surface of the outer shell of the Fibrestone wall. This pattern or texture can be applied to the upper surface of the belt 10 in any desired manner so long as it embodies a sufficient degree of flexibility that it can traverse the rollers 12, 14 and 18 without being damaged as it goes around the rollers. The pattern or texture embodied in the upper surface of the belt 10 can embody relatively deep contours thereby rendering it possible to duplicate artistically desirable or attractive features.

With this improved method of making the outer wall or shell of the Fibrestone wall, a slurry of concrete having a relatively high slump, that is a relatively thin concrete mix capable of accurately reproducing intricate details such as wood graining from the pattern carrying belt 10 is discharged under pressure from a spray gun 32. This high slump concrete is reinforced by chopped up fibers of appropriate lengths which are introduced under pressure from a spray gun 34 to commingle the sprayed chopped up reinforcing fibers, such for example as glass fibers, with the sprayed concrete from the gun 32 preferably while the sprayed materials are in the air. The spray guns 32 and 34 move transversely across the belt 10 which has the pattern or textured surface to be reproduced. Preferably the guns 32 and 34 are positioned close together to permit the concrete and the reinforcing fibers to mix in the air. The transverse movement of the spray guns 32 and 34 is correlated to the speed of travel of the belt 10 and the volume of discharge from the spray guns to provide a sprayed continuous panel strip 36 embodying the desired width and depth dimensions of the panels to be formed. Attention is directed to the fact that control of the edge or width of the panel may be provided, as by the provision of an upstanding ledge to control the width of the panel being formed while the material is in the plastic or uncured state. If necessary multiple spray guns 32 for placing the necessary quantity of concrete, and multiple spray guns 34 if necessary for applying the desired fiber reinforcements can be employed.

The continuous panel strip 36 is thus formed by the operation of the spray guns 32 and 34 to place the contrete and the reinforcing fibers on the pattern carrying belt 10 with a sufficient degree of pressure to insure the picking up of the details of construction of the pattern or texture carried by the belt 10.

It will be understood that the continuous panel strip 36 embodies on its lower surface the impression of the pattern or texture carried by the upper surface of the belt 10. This is the side of the Fiberstone wall that is exposed to the atmosphere when the wall is installed in a vertical position in a building structure.

In order to secure the outer fiber reinforced shell or wall of the Fibrestone structure to the load supporting members thereof in such a manner that fluctuations of temperature will not subject the spaced wall members to breaking stresses the outer and inner wall members are secured together by flex-tie members. In this construction the flex-tie members are secured at transversely spaced points to the inner and outer wall members.

Figure 3:
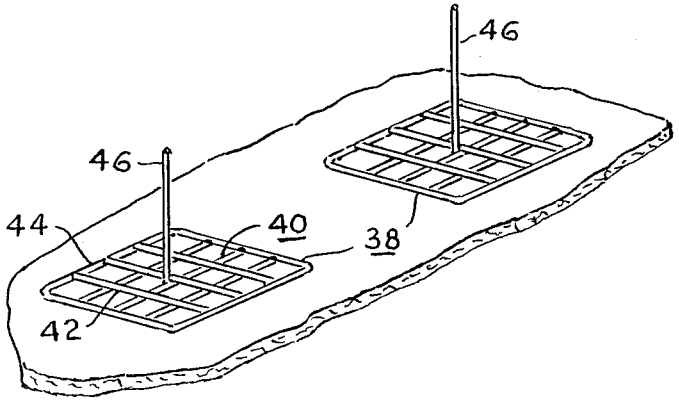
FIG. 3 is a perspective view showing a pair of the flex-tie members assembled with the fiber reinforced shell.

The flex-tie elements 38 as more clearly shown in FIG. 3 consist of a plurality of patches 40 having thin intersecting strands 42 and 44 of wire, plastic or other suitable material secured together in intersecting form adhesively or by welding to provide a strong matrix. The patches 40 may be of any desired size dependent on the loading to which they may be subjected to distribute the forces within the commerical sized panels formed from the continuous panel 36. The flex-tie assemblies 38 have central upstanding connector members such as the wire segments 46 connected at their lower ends to engage intersecting strands 42 and 44 of the patches 40, preferably at the approximate middle of the patches 40.

The flex-tie assemblies 38 are dropped onto the continuous panel strip 36 while the concrete and reinforcing fibers are still in the wet or uncured state, and of course while the assembly line is running. To be sure that the patches 40 are secured within the matrix of the upper or inner surface of the continuous panel 36 an additional spray gun 48 for placing concrete, and an additional spray gun 50 to spray additional fiber reinforcing members, if desired, are provided to spray an additional small quantity of concrete and reinforcing fibers or a premix of the required mixture to provide a so-called mushie 52 to insure that the patches 40 and the base of the central wire elements 46 are covered with a layer of sprayed material.

It is contemplated that the thickness of the continuous panel 36 when sprayed by the guns 32 and 34 will be approximately $\frac{1}{4}$ of an inch thick, and that when the additional concrete and fiber reinforcing sprayed by the guns 48 and 50 to cover the flex-ties 38 will add approximately an additional $\frac{1}{8}$ of an inch to the thickness of the continuous panel 36. Expressed another way it is contemplated that the thickness added by the guns 48 and 50 will add approximately one half of the thickness added by the guns 32 and 34.

As shown in FIG. 2 a plurality of spaced rows 54, 56 and 58 of flex-tie assemblies are positioned on the continuous panel 36 corresponding with the locations where the studs or other load supporting members will be positioned.

When initially sprayed on the belt 10 by the spray guns 32 and 34 the sprayed material is relatively rough or uneven in contour as some of the fibers sprayed extend upwardly above the surface of the continuous panel 36. To smooth out the upper surface of the continuous panel strip 36 a plurality of transversely extending overlappying plastic rollers 60, 62 and 64 are provided to smooth out and flatten down the top of the sprayed concrete and reinforcing fibers in the sprayed panel strip 36 between the upstanding wires 46 of the rows of flex-tie members 54, 56 and 58 and on the sides of the outside rows. The fibers which extend above the upper surface of the then just sprayed panel strip 36 will be enmeshed with the sprayed concrete when pressed down into the sprayed concrete, and will thus provide a relatively smooth flat upper surface.

Figure 4:
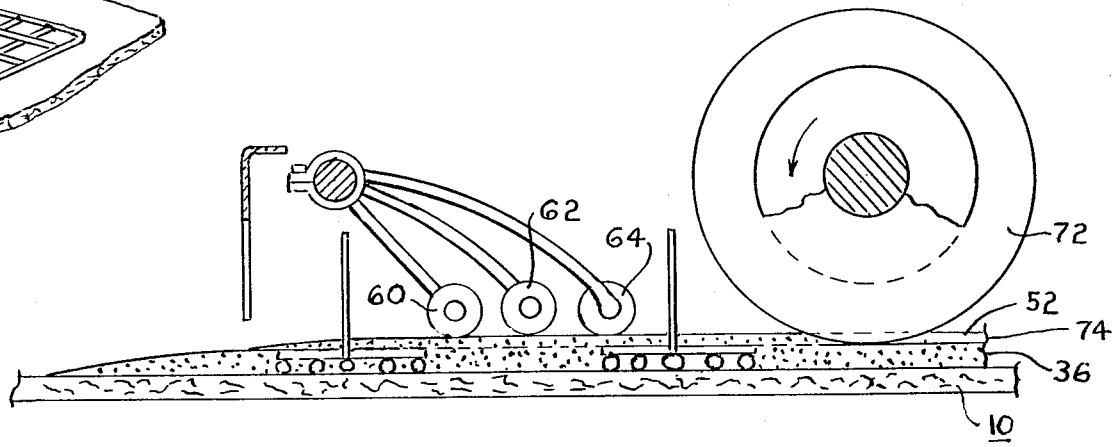
FIG. 4 is a view of a portion of FIG. 1.
Figure 5:
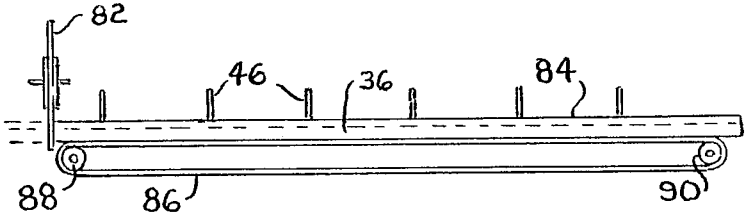
FIG. 5 is a longitudinal view of a take away belt showing the panels cut to commercial lengths.
Figure 6:
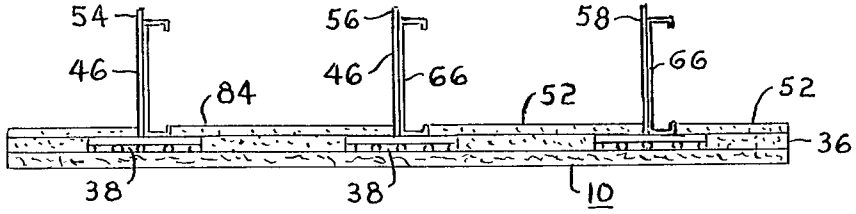
FIG. 6 is a transverse sectional view showing the flex-tie members interconnecting the fiber reinforced shell and the load supporting structure.

To provide a smooth foundation for the load supporting members, such for example as the studs 66 as shown in FIG. 6, and to insure a foundation of uniform thickness a plurality of spaced rollers 68, 70 and 72 are provided to form light depressions or paths 74, 76 and 78 in the panel strip 36 of a width corresponding with, and to receive the flanges of the studs 66 as shown in FIG. 6 and to establish the dimensional tolerance of the thickness of the panel as shown in FIG. 4.

After the flex-tie assemblies 38 have been placed on the panel 36 and the rollers 60, 62 and 64 have flattened out the material added by jets 48 and 50 the panel strip 36 enters a cure box 80 where the panel strip is subjected to accelerated curing such for example as by the application of steam or radiant heat to force a rapid cure or partial solidification of the fiber reinforced concrete panel 36. When the panel 36 has attained a predetermined partial curing or set, it passes out of the cure box 80 and is carried on down the assembly line by the belt 10. Attention is directed to the fact that if the panel strip 36 does not attain a sufficient cure while in the cure box 80, as shown, the curing cycle can be extended on down the track of the belt 10 to insure holding the material a sufficient period of time in the accelerated curing cycle to provide the desired degree of curing so that the panel strip 36 can be separated from the pattern carried by the belt 10 without fear of injuring it.

When the continuous panel strip 36 has attained a desired degree of curing the belt 10 separated from the continuous panel 36 and is directed around the roller 18 thereby withdrawing the pattern from the pattern strip 36 without subjecting the panel to a sufficient stress or bending force that would fracture the contour of the pattern impression.

After the belt 10 drops down and moves around the roller 18 it thereby moves out of alignment with a panel cutoff mechanism 82. The cutoff mechanism can take any of several forms such as a traveling saw to move with the panel strip 36 to effect a square cutoff of the panel trip 36. If desired the cutoff mechanism can be of a different form, such for example as an abrasive saw, shear, or a high pressure water jet device, any of which will provide a smooth and square cutoff of the traveling panel strip 36 to cut the strip 36 into panels 84 of commerical lengths. It will be understood that suitable supports are provided to move with the cutoff mechanism as the cutoff mechanism is in operation to prevent subjecting the panel strip 36 to breaking stresses.

A take away belt 86 is aligned with the pattern carrying belt 10 and is wrapped around drive rollers 88 and 90 and is positioned to underlie the panel strip 36 and to deliver the cutoff panels of commerical length 84 to a storage area where the panels continue to cure. After an appropriate curing cycle the panels are sufficiently strong that they are ready to be delivered for use in a cosntruction operation.

Reverting now to the pattern carrying belt 10 it will be observed that the pattern is upside down after passing around the roller 18. Any powdered concrete or other debris can then be readily removed from the pattern. Cleaning brushes 92 and 94 having soft bristles, and if desired a water spray 96 preferably between the brushes, are positioned to exert light pressure on the face of the pattern to thoroughly clean the pattern face preparatory to the next cycle of operation.

A jet 98 is provided for spraying a suitable mold release substance onto the pattern carried by the belt 10. An inspection station in the area of the rollers 12 and 14 is provided to enable the operator to inspect the pattern carried by the belt 10, and the remainder of the mechanism to be certain that everything is in operable condition.

Reverting now to the area where the continuous panel 36 has been cut transversely by the cutoff mechanism 82 a plurality of individual panels 84 of commerical lengths are provided. If desired to panels 84 with the flextie assemblies 38 in place thereon can be packaged by bending over the upstanding wire elements 46 and placing an enclosure around the panels to protect the flex-tie wire elements 46, and the panels 84 can then be shipped to the point of use.

It will also be understood that if desired a outside frame having suitable studs 66 therein can be lowered onto the take away belt 86 it being noted that the studs 66 align with the upstanding wire elements 46 of the flex-tie assemblies. The wire elements 46 of the flex-tie assemblies can then be secured to the studs 66 at points remote from the panel 36 near the top of the studs 66 in any suitable manner as by welding. Any excess lengths of the wires 46 of the flex-tie assemblies can be snipped off or they can merely be bent over so as not to interfere with any interior wall structure to be added to the studs to provide the inside wall of the building. If desired the excess lengths of the upstanding wires can be bent over and used to anchor insulation in place.

It will be apparent that if desired the assembly line herein disclosed can be used to provide panels for use in refurbishing the appearance of buildings. This type of work is frequently referred to as Rehabilitation work or to the formation of Rehab panels. They are panels of a single thickness and preferably have the decorative outer surface formed by the use of the pattern or texture carried by the belt 10. The jet 32 discharges concrete under pressure and the fiber reinforcement is discharged by the jets 34. Also it will be apparent that if desired a series of transversely spaced jets or a continuous discharge nozzle may discharge concrete and fiber reinforcement to provide continuous discharge rather than moving the jets transversely of the belt 10.

To provide Rehab panels it is only necessary to employ the primary concrete and fiber reinforcing jets 32 and 34 because to provide the ornamental panels it is unnecessary to provide the load supporting structure because no substantial loads are carried.

I claim:

1. An assembly line method for forming a composite wall including a thin fiber reinforced shell having an outer surface reproduced from a pattern to provide the outer surface of the wall to be exposed to the atmosphere comprising the steps of (1) providing a movable belt, (2) positioning on the belt a pattern having the desired contouring to be applied to the outer surface of the wall, (3) spraying concrete and reinforcing fibers on the pattern to provide a continuous panel strip, (4) placing on the continuous panel strip spaced rows of flex-tie members each having expanded bases and upstanding central elongated fasteners, (5) spraying additional concrete and reinforcing fibers to cover the expanded bases of the flex-tie members, (6) rolling the areas between the rows of flex-tie members to insure the covering of the flex-tie bases and the provision of a relatively flat surface, (7) providing grooves in the continuous panel strip to control the effective thickness of the panel strip, (8) accelerating the curing of the continuous panel strip, and (9) cutting the continuous panel strip into panels of commercial lengths.

2. The invention defined in claim 1 wherein spaced studs provide load supporting members and the grooves in the continuous panel strip are adjacent the upstanding central elongated fasteners of the flex-tie members to provide a seat for the studs, and securing the elongated fasteners of the flex-tie members to the studs at locations remotely spaced from the inner surface of the reinforced shell.

3. The method of making the fiber reinforced shell of a composite wall having on one side a surface defining the outer surface of the shell to be exposed to the atmosphere, and having an inside surface, the fiber reinforced shell having upstanding flex-tie members adhesively secured at one of their ends to the inside surface of the shell and adapted at the other end to be secured to a load supporting structure at points remotely spaced from the inside surface of the shell comprising the steps of (1) positioning on the surface of a belt the surface to be reproduced in the outer surface of the shell to be exposed to the atmosphere, (2) driving the belt, (3) providing concrete and fiber reinforcing spray guns to spray on the belt a continuous panel strip, (4) depositing on the inside surface of the shell spaced rows of said flex-tie members on the continuous panel strip while the strip is in the uncured state, (5) contouring the continuous panel strip to provide paths marking the location of load supporting members, (6) separating the belt from the continuous panel strip, and (7) cutting the continuous panel strip into longitudinally spaced panel members of desired lengths for use.

4. The invention defined in claim 3 wherein the concrete and the fiber reinforcing spray guns are movable transversely of the path of travel of the belt to spray on the belt the continuous panel strip.

5. The invention defined in claim 3 wherein after the flex-ties have been deposited on the continuous strip additional concrete is sprayed on the continuous panel strip to provide a small build-up around the flex-tie assemblies to insure securing one end of the flex-ties to the inner surface of the continuous strip.

6. The invention defined to claim 3 wherein load supporting members including spaced studs are assembled in the paths marked in the continuous panel strip.

7. The invention defined in claim 6 wherein the outer ends of the flex-ties are secured to the spaced studs at points remote from the inner surface of the shell.

8. The invention defined in claim 7 wherein the outer ends of the flex-ties are secured to the spaced studs by welding.

9. The method of making a fiber reinforced shell of a composite wall which comprises the steps of (1) forming on a moving belt a continuous panel strip by depositing by spraying under pressure from separate spray nozzles concrete and chopped up fiber reinforcing on said moving belt; (2) depositing on the continuous panel strip a plurality of spaced flex-tie members; (3) rolling by rollers having their axes extending transversely of the continuous panel strip to smooth out the upper surface of the continuous panel strip; (4) subjecting the fiber reinforced shell to accelerated curing; and (5) cutting the continuous panel strip while the belt is moving to provide a plurality of panels of convenient size for use.

10. The invention defined in claim 9 wherein load supporting members including spaced studs are positioned on individual panels.

11. The invention defined in claim 10 wherein the flex-ties are secured to the studs at points spaced remotely from the panels.

* * * * *